US009115955B2

(12) United States Patent
Barnhart

(10) Patent No.: US 9,115,955 B2
(45) Date of Patent: Aug. 25, 2015

(54) ARTWORK DISPLAY FRAME AND RELATED METHODS

(71) Applicant: America Grip, LLC, Austin, TX (US)

(72) Inventor: Dan Barnhart, Austin, TX (US)

( * ) Notice: Subject to any disclaimer, the term of this patent is extended or adjusted under 35 U.S.C. 154(b) by 0 days.

(21) Appl. No.: 14/074,561

(22) Filed: Nov. 7, 2013

(65) Prior Publication Data

US 2014/0325888 A1 Nov. 6, 2014

Related U.S. Application Data

(60) Provisional application No. 61/818,984, filed on May 3, 2013.

(51) Int. Cl.
*F41C 23/16* (2006.01)
*A47G 1/06* (2006.01)

(52) U.S. Cl.
CPC .. *F41C 23/16* (2013.01); *A47G 1/06* (2013.01)

(58) Field of Classification Search
CPC ..... F41C 23/16; F41C 23/22; A47G 1/06
USPC ..... 42/71.01, 96, 90, 106, 108; D22/108
See application file for complete search history.

(56) References Cited

U.S. PATENT DOCUMENTS 4,697,367 A * 10/1987 Brophy ..... 42/71.01
5,048,213 A * 9/1991 Gerhard ..... 42/71.01
5,048,215 A * 9/1991 Davis ..... 42/72
5,068,991 A * 12/1991 Reed ..... 42/71.01
5,826,363 A * 10/1998 Olson ..... 42/75.01
6,609,321 B2 * 8/2003 Faifer ..... 42/71.01
6,725,594 B2 * 4/2004 Hines ..... 42/90
6,782,652 B1 * 8/2004 Erickson ..... 42/143
D625,378 S * 10/2010 Fitzpatrick et al. ..... D22/108
7,856,749 B2 * 12/2010 Fitzpatrick et al. ..... 42/96
7,971,383 B2 * 7/2011 Fitzpatrick et al. ..... 42/96
8,650,793 B1 * 2/2014 Mendez ..... 42/90
2003/0074822 A1 * 4/2003 Faifer ..... 42/71.01
2003/0106252 A1 * 6/2003 Hines ..... 42/90
2004/0064994 A1 * 4/2004 Luke ..... 42/85
2006/0075672 A1 * 4/2006 Romer ..... 42/10
2009/0241397 A1 * 10/2009 Fitzpatrick et al. ..... 42/90
2010/0236124 A1 * 9/2010 Troy ..... 42/90
2011/0099879 A1 * 5/2011 Fitzpatrick et al. ..... 42/90
2012/0085013 A1 * 4/2012 Cahill ..... 42/96
2013/0326925 A1 * 12/2013 Power ..... 42/71.01

* cited by examiner

*Primary Examiner* — Joshua Freeman
(74) *Attorney, Agent, or Firm* — The Villhard Patent Group

(57) ABSTRACT

Frames for displaying 3D and/or user-selected pieces of artwork and related methods. Some frames comprise frame and rail engagement portions. The frame portions display the artwork and further comprise bodies defining curvilinear cross-sections and display areas on exterior surfaces of the bodies. The rail-engagement portions can couple to the frame portions and further comprise ridges. The ridges extend away from interior surfaces of the frame bodies and can be adapted to engage rails. Flats adjacent to the rails can facilitate securing the frames to the rails. Moreover, display areas of the current embodiment define the artwork. The bodies and rail engagement portions can withstand various shocks at the rails. Moreover, the bodies can be hand guards for weapons. Furthermore, the rail engagement portions can define apertures which receive weapons tools. Moreover, the frame portions can define stops which engage slots associated with the rails. If desired, engravings define the artwork.

17 Claims, 9 Drawing Sheets

ARTWORK DISPLAY FRAME AND RELATED METHODS

This application is a non-provisional application of and claims priority to provisional U.S. Patent Application No. 61/818,984, filed on May 3, 2013, by Daniel Barnhart, and entitled Weapon With Artwork Surface the entirety of which is incorporated herein as if set forth in full.

BACKGROUND

Much artwork is delicate and not suitable for surviving harsh environments such as those found on (and/or associated with) automatic weapons. For instance, artwork displayed on paper, fabric, etc. would deteriorate rapidly under the influence of the shock and vibration present on most automatic weapons due to their "firing." Likewise, heat can be a factor limiting a user's ability to place artwork in certain environments (such as on their weapons) particularly if the artwork sags or might otherwise contact potentially hot objects in the environment (such as, again, the barrel of a weapon). The user's incidental or accidental handling of the artwork might also cause degradation of the artwork. For instance, Should a user somehow affix artwork to a weapon, their handling of the weapon would likely expose the artwork to the forces inherent in gripping the weapon as they move through brush and position and/or fire it. Moreover, the design and/or functional characteristics of most weapons limit the number and size of surfaces available for anything but utilitarian functions leaving little (if any) room for artwork to be applied thereto. Yet many gun owners wish to personalize their weapons.

SUMMARY

The following presents a simplified summary in order to provide an understanding of some aspects of the disclosed subject matter. This summary is not an extensive overview of the disclosed subject matter, and is not intended to identify key/critical elements or to delineate the scope of such subject matter. A purpose of the summary is to present some concepts in a simplified form as a prelude to the more detailed disclosure that is presented herein. The current disclosure provides systems, apparatus, methods, etc. for displaying artwork and more specifically for displaying artwork in environments wherein the artwork might be subject to shock, thermal extremes, mishandling, etc.

Some embodiments provide frames for displaying three-dimensional and user-selected pieces of artwork wherein the frames comprise frame portions and rail engagement portions. In some embodiments the frame portions are adapted to display the pieces of artwork and further comprise frame bodies defining generally arc-shaped cross-sections (as viewed along longitudinal axes of the frame bodies) and display areas disposed on exterior surfaces of the arc-shaped frame bodies. The rail-engagement portions of the current embodiment couple to the frame portions and further comprise pairs of ridges. These ridges extend generally inwardly from interior surfaces of the arc-shaped frame bodies and are adapted to engage tactical rails. Moreover, the display areas of the current embodiment define three-dimensional and user-selected pieces of artwork therein and/or thereon.

The frame bodies and rail engagement portions can be adapted to withstand shocks of at least 45 foot-pounds transmitted from the pairs of rails applied at least 10,000 times and (in some embodiments) hundreds of thousands of times. In the alternative, or in addition, the frame bodies can define flats generally adjacent to the ridges and these flats can be configured to increase (static) friction between the artwork frames and the tactical rails. In some embodiments the frame bodies are adapted to be hand guards for automatic weapons and/or the pairs of ridges can be adapted to engage Picattiny rails. In the alternative, or in addition, the rail engagement portions (and perhaps other portions) define tool apertures adapted to receive weapons tools. Thus, when the ridges are engaged with the tactical rails and the tool apertures have received the weapons tools, the weapons tools engage slots associated with the tactical rails. Moreover, the artwork frame portions can define stops adapted to engage slots associated with the tactical rails. If desired, engravings define the three-dimensional and user-selected pieces of artwork. In some embodiments, the artwork defines thinned sections of the frame bodies.

Some embodiments provide hand guards for weapons which include barrels. Such hand guards comprise frame portions which are adapted to display pieces of artwork. Furthermore, the artwork frame portions further comprise frame bodies and rail engagement portions. The frame bodies define generally arc-shaped cross-sections and display areas disposed on exterior surfaces of the arc-shaped frame bodies. The rail-engagement portions couple to the frame portions and further comprise pairs of ridges extending generally inwardly from interior surfaces of the arc-shaped frame bodies and are adapted to engage tactical rails. In addition, the display areas define the pieces of artwork therein.

To the accomplishment of the foregoing and related ends, certain illustrative aspects are described herein in connection with the annexed figures. These aspects are indicative of various non-limiting ways in which the disclosed subject matter may be practiced, all of which are intended to be within the scope of the disclosed subject matter. Other novel and nonobvious features will become apparent from the following detailed disclosure when considered in conjunction with the figures and are also within the scope of the disclosure.

BRIEF DESCRIPTION OF THE FIGURES

The detailed description is described with reference to the accompanying figures. In the figures, the left-most digit(s) of a reference number usually corresponds to the figure in which the reference number first appears. The use of the same reference numbers in different figures usually indicates similar or identical items.

DETAILED DESCRIPTION

This document discloses systems, apparatus, methods, etc. for displaying artwork and more specifically for displaying artwork in environments wherein the artwork might be subject to shock, thermal extremes, mishandling, etc.

Figure 1:
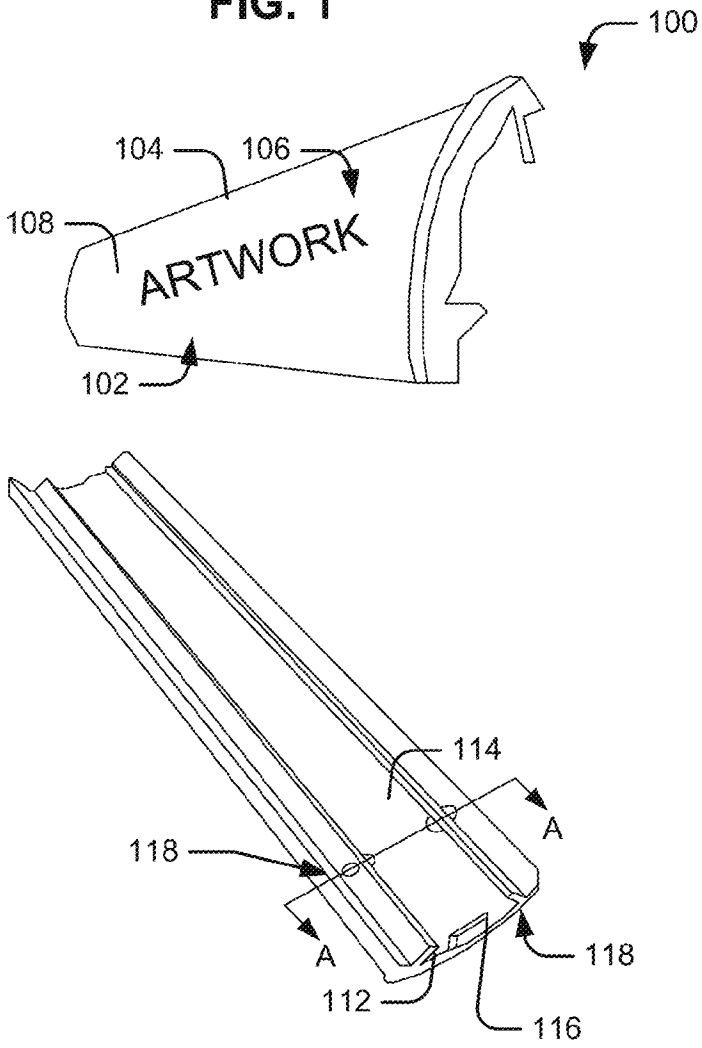
FIG. 1 illustrates an artwork frame.

FIG. 1 illustrates an artwork frame. More specifically, FIG. 1 illustrates an artwork frame 100, artwork 102, a frame body 104, a display area 106, an exterior surface 108, a rail engagement portion 110, ridges 112, an interior surface 114, a stop 116, and tool apertures 118. In the current embodiment, the artwork frame 100 holds or defines the artwork 102. That artwork 102 can be selected by the user and can be three-dimensional in nature. For instance, the artwork 102 can be an engraved piece of artwork, an embossed piece of artwork, artwork defined by stamping, punching, etching, etc. or some other type of three-dimensional artwork.

The frame body 104 of the current embodiment is elongated in a direction generally parallel to its longitudinal axis x. Moreover, it defines an arc-shaped cross-section when viewed in a direction more or less parallel to the longitudinal axis x. Thus, the artwork 102 is displayed on the curve-linear display area 106 and (in general) shares that curve-linear shape. The curve-linear presentation of the artwork 102 can make it appear more prominently and/or give the artwork 102 a "bolder" appearance than might otherwise be the case. If desired, that curve-linear display area could also/instead include one or more flat, linear, and/or angled surfaces. With regard to the frame body 104, it can define the exterior surface 108 of which the display area 106 can be a portion thereof. Moreover, it can also generally reflect the arc-shaped cross-section and can be made of any of a number of materials. For instance, the frame body 104 can be made of nylon, acrylonitrile butadiene styrene (ABS) plastic, cast iron, brass, bronze, aluminum, titanium, etc.

The rail engagement portion 110 of the current embodiment couples to the frame body 104 and, if desired, can be formed integrally therewith. Moreover, the rail engagement portion 110 can include or define one or more of the ridges 112. These ridges 112 can serve to mount and/or removably attach the artwork frame 100 to a tactical rail on an object or surface on which a user might wish to display the artwork 102. Note that the tactical rail need not be on any particular object to be within the scope of the current disclosure. For instance, it can be mounted to a weapon. However, suitable tactical rails and/or other mounting hardware could be affixed to a surface such as a wall in a museum without departing from the scope of the current disclosure.

Still with reference to FIG. 1, the ridges 112 point generally inwardly from the interior surface 114 although there may be fairly significant departures from an "inward" direction so long as the ridges 112 point in a direction allowing them to engage the tactical rails (disclosed further elsewhere herein). Furthermore, so long as the rail engagement portion 110 can engage the tactical rails of (for instance) a weapon, the ridges can be any shape and might not be true "ridges". Rather, the ridges could be a one or more spaced apart posts or other structures that, together, act as a ridge by engaging tactical rails sufficiently to attach the artwork frame 100 thereto.

With continuing reference to FIG. 1, the artwork frame 100 of the current embodiment also defines features that can be used to secure the artwork 102 to the objects, surfaces, etc. to which users might want to mount the artwork 102. For instance, the rail engagement portion 110 can define a stop 116 which (in the current embodiment) is a raised portion of the interior surface 114. It can be adapted to engage a slot associated with the tactical rails. In addition, or in the alternative, the artwork frame 100 can define tool apertures 118 adapted to accept various weapons tools (disclosed further elsewhere herein). The tool apertures 118 can penetrate a portion of the frame body 104, the display area 106, the exterior and interior surfaces 108 and 114, the rail engagement portion 110, the ridges 112, etc. Further, the tool apertures 118 can accept weapon tools and by engaging therewith can secure the artwork frame 100 to a surface, object, etc.

Figure 2:
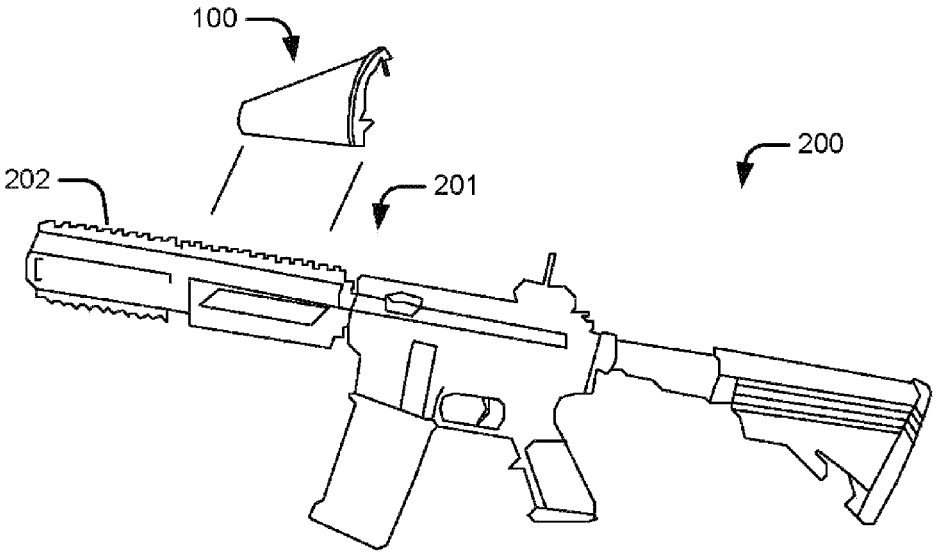
FIG. 2 illustrates an object on which the artwork frame of FIG. 1 can be mounted.

FIG. 2 illustrates an object on which the artwork frame of FIG. 1 can be mounted. More specifically, the object (in the current embodiment) happens to be a weapon 200 but could be any object with a tactical rail or similar structure. For instance, some rails on such objects could comprise separate, spaced apart posts or other structures that can serve as rails. The weapon 200 of the current embodiment could be any type of weapon such as a rifle, shotgun, automatic weapon, semi-automatic weapon, etc. (AR-15s, AK-47s, M-16s, etc.). Many such weapons 200 include Picatinny rails, MIL-STD-1913 rails, STANAG 2324 rails, and/or other brackets or hardware for attaching accessories to the weapon 200. All such tactical rails 201 are thus within the scope of the current disclosure. Tactical "rails" 201 usually include one or more grooves 202 on each side of the weapon 200 and a plurality of slots 204 on the top of the tactical rails 201. Moreover, tactical rails 201 come in a variety of lengths and can be positioned at many differing locations on weapons 200.

FIG. 2 also shows that some artwork frames 100 can slide onto or otherwise attach to the tactical rail 201 by way of the ridges 112. These ridges 112 correspond in shape and size to the grooves 202 of the tactical rail 201. In addition, or in the alternative, the stop 116 corresponds in size and shape to the slots 204. Thus, when the ridges 112 are engaged with the grooves 202, the stop 116 can engage one of the slots 204 thereby preventing (or limiting) relative motion along the longitudinal axes x between the artwork frame 100 and the weapon 200.

In some embodiments, the tool apertures 118 also have a role in limiting relative motion between the artwork frame 100 and the weapon 200. More specifically, the tool apertures 118 can be spaced apart from the stop 116 and/or each other by about the same distance as exists between slots 204 of many tactical rails 201. Moreover, the tool apertures 118 form corresponding passages from one side of the artwork frame 100 to the other. Those passages extend through one side of the frame body 104 (near its edge), thence through the adjacent ridge 112, and then through the other ridge 112 and then the other side of the frame body 104 (near its opposite edge). The apertures can correspond in diameter to the diameter of various weapons tools so that one (or more) of these weapons tools can be inserted through the tool apertures 118. Moreover, the weapon tools and tool apertures 118 can form an interference fit there between so as to help retain the weapon tools in the tool apertures 118. As a result, when the artwork frame 100 is coupled to the weapon 200, the weapons tool(s) will pass through one of the slots 204 of the tactical rail 201 and help secure the artwork frame 100 to the weapon 200. The tool apertures 118 therefore also provide a convenient location to store such weapons tools. And, if desired, certain tool apertures 118 can be adapted to hold two or more weapon tools.

With continuing reference to FIG. 2, the artwork frame 100 of the current embodiment can be configured to be a hand guard for various weapons 200 and/or other objects to which the artwork frame 100 might removably attach. More specifically, the artwork frame 100 can be made of nylon, aluminum, etc. or some other material capable of withstanding the temperatures and the repeated shocks likely to be experienced while it is mounted on a weapon 200. In addition, the artwork frame 100 of the current embodiment possesses sufficient rigidity to withstand such shocks and/or other environmental and/or handling factors without deforming enough that the frame body 104 might contact the weapon barrel or other hot surfaces of the weapon 200. This might be desired because the temperature at the end of some automatic weapons can reach hundreds of degrees Fahrenheit which would degrade or destroy much heretofore-available artwork. As to the shock and/or vibration possible in some environs, Table 1 lists some data illustrative of the shocks associated with firing various weapons. Artwork frames 100 of embodiments are made of materials and/or are configured so as to survive in such environments although less rigid artwork frames 100 are within the scope of the current disclosure.

TABLE 1

Typical Weapon-Related Shock Data

| Gun Type | Recoil Force (ft-lbs) |
|---|---|
| .223 Rifle (M-16) | 3.2 |
| .308 Rifle (M-14) | 15.8 |
| 12 Gauge Shotgun | 45 |
| .458 Elephant Gun | 62.3 |

The artwork frame illustrated by FIG. 2 happens to arc through about 30 degrees and has a width of about 1.5 inches. It's radius of curvature is thus about 2 inches. particular artwork frame 100, therefore, covers the upper surface of many weapons 200 although other configurations are within the scope of the current disclosure. For instance, the artwork frame 100 could arc, turn, bend, etc. to cover the sides of the weapon 200 or could extend in a circle (or otherwise enclosing shape) to fully or partially envelop the weapon. Its radius of curvature could also be reduced (increased) to make for a more compact (larger) frame if desired. Thus, its size can be tailored to the environment in which it might be used and/or the size of the artwork 102 desired to be displayed thereon. If the artwork 102 might be displayed in a brushy area, for instance, its size can be reduced. If, though, the artwork 102 is to be displayed in an indoor (or snag-free) environment such as museum or restaurant, its size could be increased. FIG. 2 illustrates that the artwork frame 100 of the current embodiment is about 6 inches in length and thus only covers a portion of many weapons 200 and/or many tactical rails 201. However, it could extend further (or a lesser distance) along the longitudinal axis x so that it coves more (or less) of the weapon 200. Its width could also be increased or decreased as desired without departing from the scope of the current disclosure. It might also be worth noting that while certain directionally oriented terms (such as up, down, width, length, interior, exterior, etc.) are used herein, their use is for the sake of convenience and does not limit artwork frames of the current disclosure to any particular orientation, position, etc.

Figure 3:
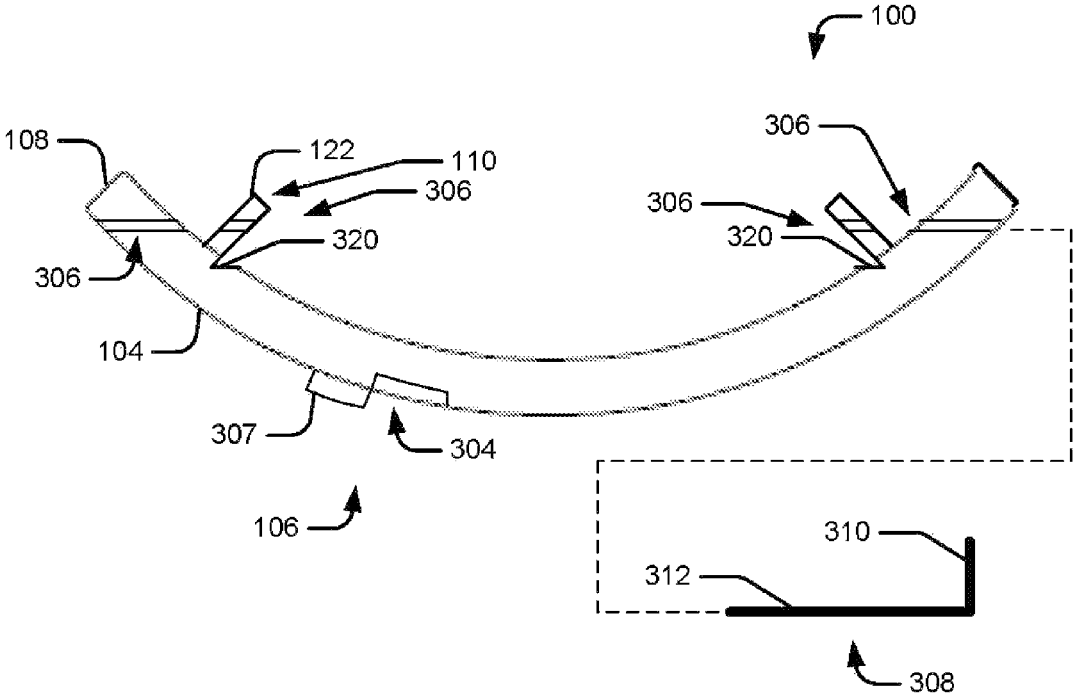
FIG. 3 illustrates a cross-sectional view of an artwork frame taken along line AA in FIG. 1.

FIG. 3 illustrates a cross-sectional view of an artwork frame taken along line AA in FIG. 1. More specifically, FIG. 3 illustrates a thinned section 304 of the frame body 104, tool apertures 306, a weapons tool 308, and a more or less V-shaped structure 309. The artwork 102 can define the thinned section 304 and, for that matter, sections that are not thinned (or sections 307 that are thicker than other sections of the frame body 104). For instance, if the artwork 102 is an engraving or some other structure formed by removing material from the frame body 104, then the artwork 102 does define a thinned area 304. Of course, if the artwork 102 is formed by adding material to the frame body (as with embossing), then the artwork 102 defines a thickened section 307 of the frame body 104.

Furthermore, FIG. 3 illustrates a particular weapons tool 308. This particular weapons tool 308 happens to be a hex wrench although many other tools are within the scope of the current disclosure. And, indeed, many weapons tools 308 include a handle 310 and a shank 312. The latter being one of the portions of the weapons tool 308 that can slide and/or plug into the weapons tools apertures 116 as disclosed further elsewhere herein.

FIG. 3 also illustrates that the interior surface 114 can define a pair of flats 320 adjacent to the ridges 112. These flats 320 can be positioned and angled such that they ride against corresponding surfaces on the tactical rails 201. They can also be roughened or coated with a material having a relatively high coefficient of friction (when slid over typical tactical rail 201 materials such as gun metal). Thus, these flats 320 can increase the amount of friction and/or stiction between the artwork frame 100 and the tactical rail 201 thereby aiding in holding the two objects in fixed relationship to one another. With reference still to FIG. 3, it might be interesting to note that the outer edges of the frame body 104 and the ridges 112 form the V-shaped structures 309 with the flats 320 further accentuating this feature of the current embodiment.

Figure 4:
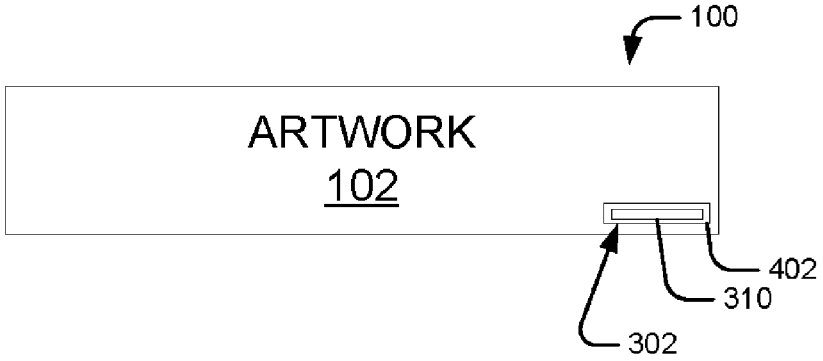
FIG. 4 illustrates a side-view of an artwork frame.

FIG. 4 illustrates a side-view of an artwork frame. More specifically, FIG. 4 illustrates a recess 402 in the frame body 104 into which the handle 310 of the weapons tool 308 can fit. Thus, the weapons tool 308, when in the tool apertures 118 can rest more or less flush against the artwork frame 100 yielding little if anything to visually draw attention away from the artwork 102. The recess 402 can also reduce or prevent the user's hand (or other objects in the environment) from accidentally snagging the tool.

Figure 5:
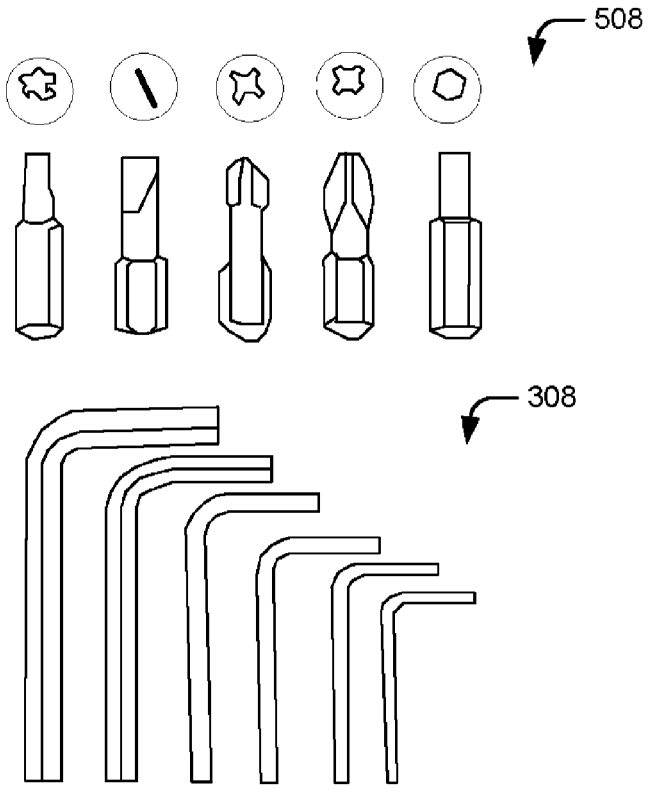
FIG. 5 illustrates a set of weapons tools.

FIG. 5 illustrates a set of weapons tools. Such sets of weapons tools 308 and 508 can include (but are not limited to): a Phillips head drill bit, a flat screw head drill bit, a file, punches (both 3/32" and 5/32") a hex driver, a stainless pointed knife, and/or a magnesium rod (for camping). These weapon tools 308 and 508, while probably an incomplete set, provide a gun user enough capability that the user can fix, adjust, maintain, etc. most weapons in the field with them. Accordingly, in some embodiments, artwork frames provide tool apertures for the foregoing weapon tools and 508 and/or other tools.

Figure 6:
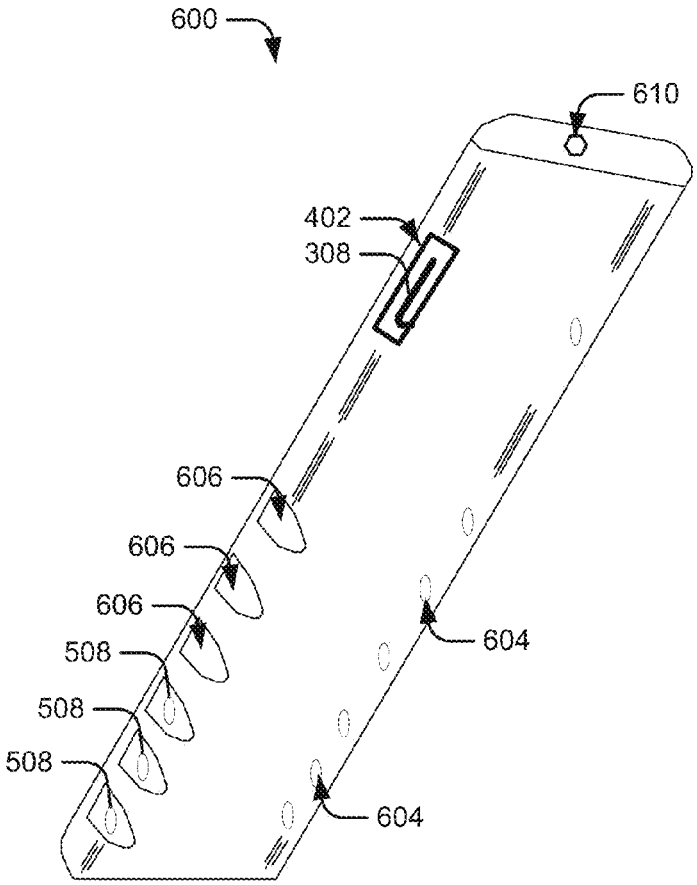
FIG. 6 illustrates a perspective view of another artwork frame.

FIG. 6 illustrates a perspective view of another artwork frame. More specifically, FIG. 6 illustrates an artwork frame 600 for holding a set of weapons tools 308 and 508. FIG. 6 therefore also illustrates a plurality of tool apertures 606 each of which can be tailored in size and shape to accommodate various weapons tools 308 and 508. The tool apertures 606 can be spaced apart so that the weapons tools 308 and 508 can engage respective slots 204 in typical tactical rails 201. Thus, the weapons tools 308 and 508 help secure the artwork frame 600 to the tactical rails. The slots 204 of the tactical rails (or rather their walls) can help retain the weapons tools 308 and 508 in their respective tool apertures 606 in some embodiments. Note that the tool apertures 606 are generally closed at one end. Yet, corresponding and relatively small tool apertures 606 can allow certain smaller weapons tools 308 to penetrate the entire artwork frame 600.

Figure 11:
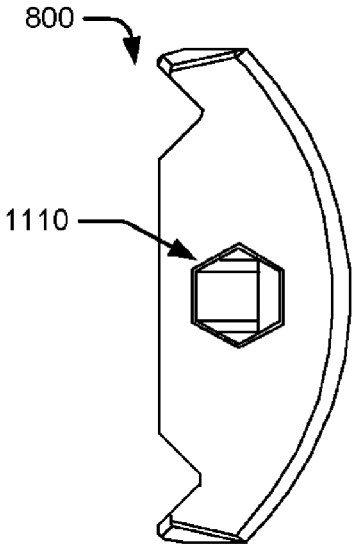
FIG. 11 illustrates another side elevation view of an artwork frame.

FIG. 6 also illustrates tool adaptor 610. The tool adaptor 610 allows a user to insert a tool into the tool adapter 610 and to use the artwork frame 600 as a screwdriver or wrench and/or a "cheater bar" for the various tools. For instance, the tool adapter 610 can be hexagonal in shape so that a hex wrench or Allen wrench can be inserted therein. The user can then grip the artwork frame 600 by the opposite end to gain mechanical advantage for turning the tool (and/or fasteners upon which it might be applied). Such tool adapters 610 can be located on the stops and/or other surfaces of artwork frames of various embodiments. Note that FIGS. 11 and 12 also illustrates certain tool adapters 1110 and 1210.

Figure 7:
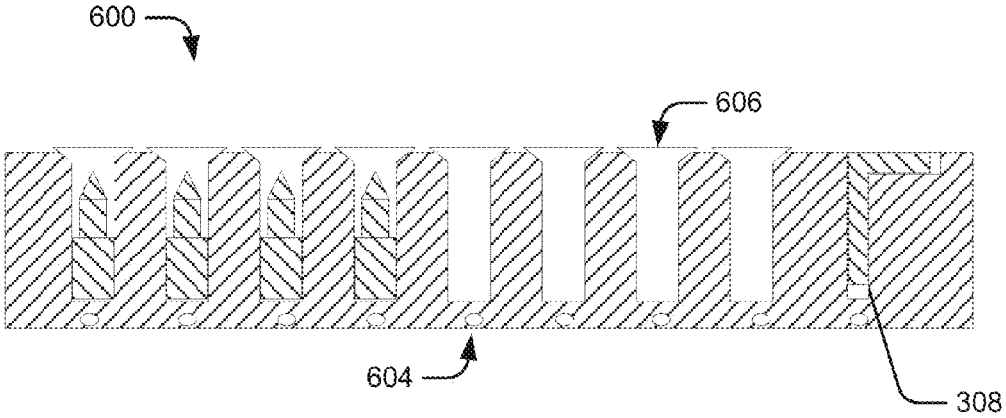
FIG. 7 illustrates a cross section of an artwork frame.
Figure 8:
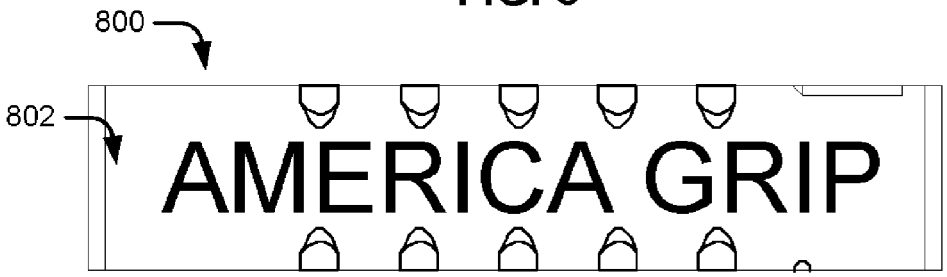
FIG. 8 illustrates a top plan view of an artwork frame.
Figure 9:
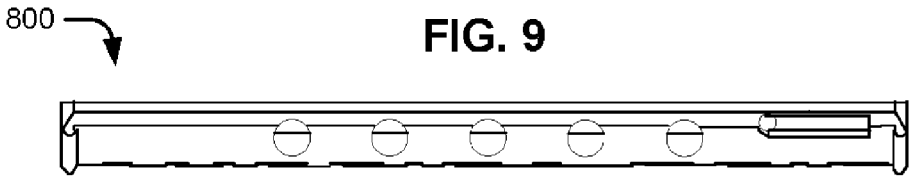
FIG. 9 illustrates a side elevation view of an artwork frame.
Figure 10:
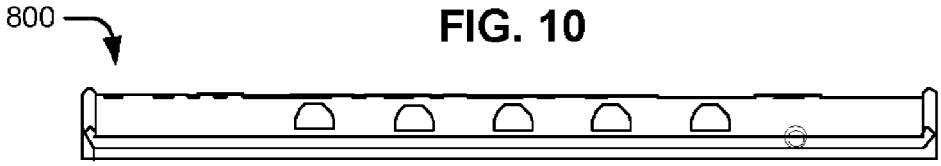
FIG. 10 illustrates a side elevation view of an artwork frame.

FIG. 7 illustrates a cross section of an artwork frame. More specifically, FIG. 7 shows various tool apertures 606 holding various weapons tools 508. Of course, if desired, one or more of the tool apertures 606 could be configured to hold a weapons tool 308.

FIGS. 8-14. Illustrate various views of an artwork frame. More specifically, FIGS. 8-14 illustrate a top plan view, three side elevation views (as seen from both sides and an end of the artwork frame 800), a bottom plan view, and two perspective views (as seen from general above and below) of the artwork frame 800 of embodiments. Thus, FIGS. 8-14 illustrate the ornamental appearance of an artwork frame 800 of the current embodiment. Note though that the particular artwork 802 displayed thereon is merely illustrative and in no way limits the scope of the current disclosure.

Figure 12:
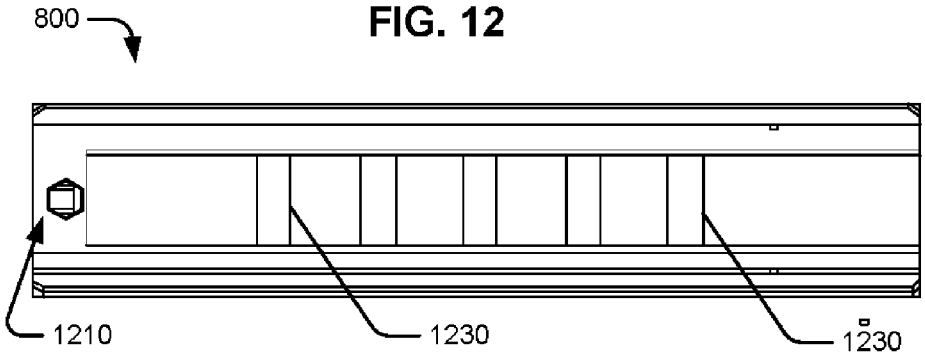
FIG. 12 illustrates a bottom plan view of an artwork frame.
Figure 13:
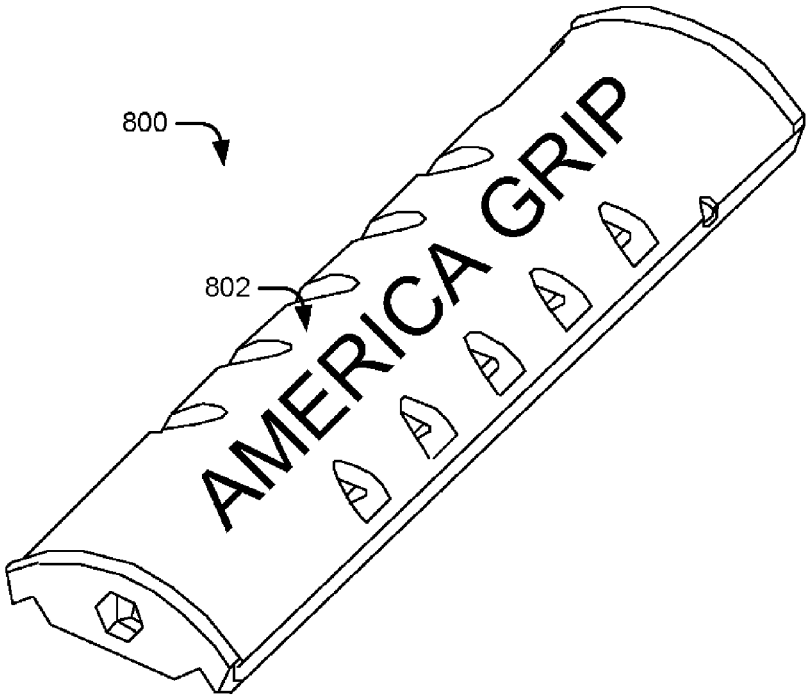
FIG. 13 illustrates a perspective view of an artwork frame as viewed generally facing an exterior surface thereof.
Figure 14:
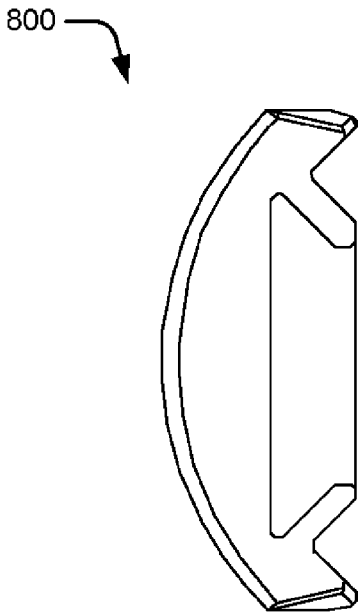
FIG. 14 illustrates another side elevation view of an artwork frame.

FIG. 12, as noted elsewhere herein, illustrates a bottom plan view of an artwork from of embodiments. The artwork frame 1200 includes ridges 1230 spaced apart and/or otherwise shaped and dimensioned to mate with the grooves on various Picatinny rails. Thus, the ridges 1230 can aid in securing the artwork frame 1200 to objects with Picatinny rails such as automatic weapons.

Figure 15:
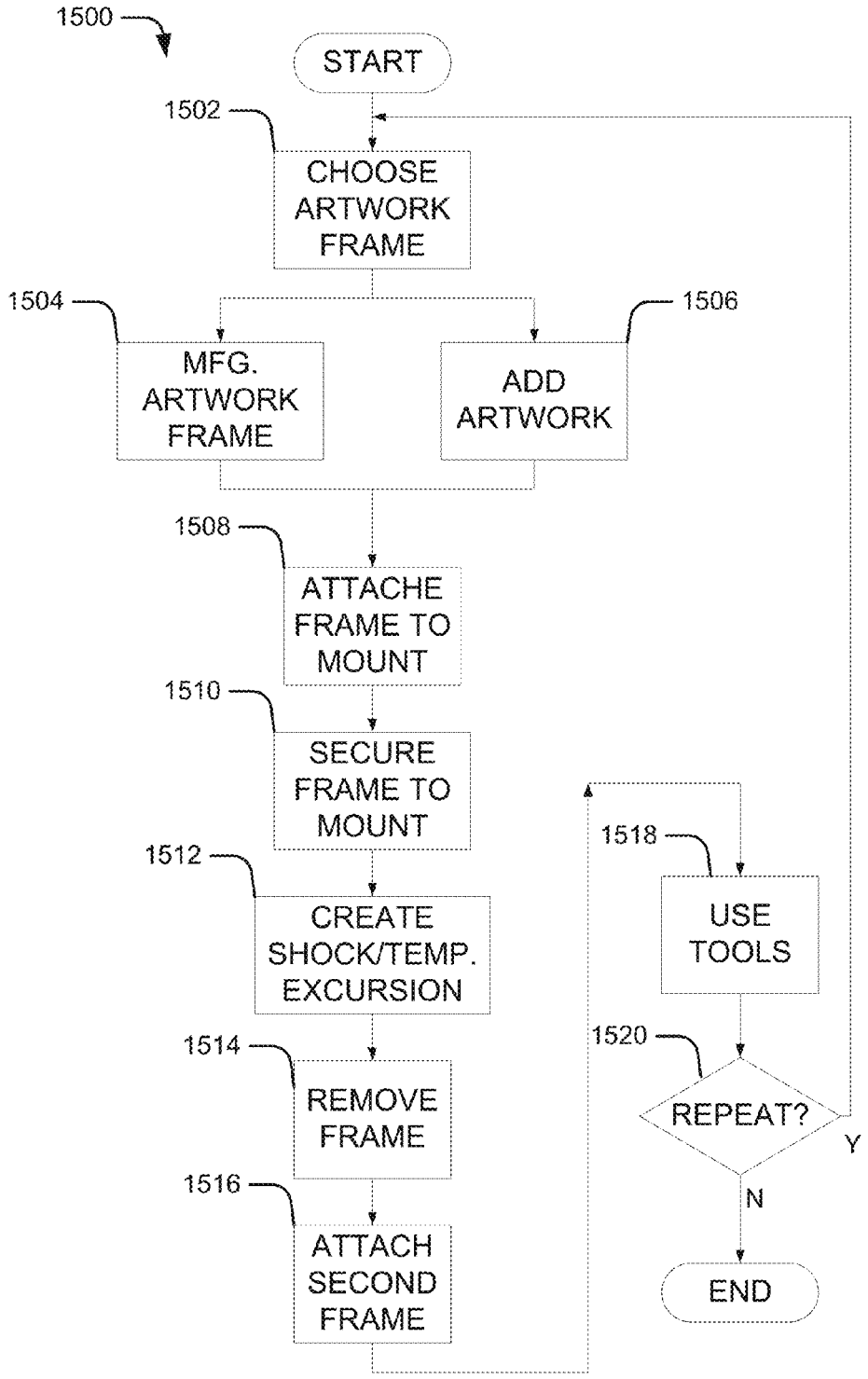
FIG. 15 illustrates a flowchart of a method of manufacturing artwork frames.

FIG. 15 illustrates a flowchart of a method of manufacturing artwork frames. More specifically, FIG. 15 illustrates method 1500 which can begin with a user selecting the type of artwork frame 100 which they are interested in manufacturing and/or having manufactured. For instance, the user can select the size (length, width, radius of curvature, etc.) of the artwork frame 100. Moreover, the user can select the type of tactical rail 201 onto which the artwork frame can attach. Accordingly, the type of rail engagement portion 110 can be decided upon based on such a selection. Further, still, the user can select the material type and/or color of the artwork frame 100. For instance, if the user is interested in having the artwork frame 100 used with an AR (colloquially, an "automatic rifle") with a Picatinny rail, the user can select an artwork frame 100 of an appropriate size which is outfitted with ridges 112 corresponding in shape, size, spacing, etc. corresponding to it. See reference 1502.

At reference 1504, method 1500 includes manufacturing the artwork frame 100 as selected by the user. For instance, if the artwork frame 100 is to be made of a polymer or other plastic or plastic-like material, then a mold can be made for it and the part can be molded from the material. In the alternative, if the selected material can be extruded, then a die manufacturing system can be set up and the part extruded. Of course, in either situation, the parts can be cut, trimmed, de-burred, etc. during/after their manufacture. Additionally, the part can be painted after the fact or pigments can be added to the raw material (before molding) to yield an artwork frame of the selected color.

Depending on how the artwork 102 is to be added to the artwork frame 100, the artwork 102 can be added during the manufacturer of the artwork frame 100 or afterwards. See reference 1506. For instance, if the artwork 102 is to take the form of an engraving, then the artwork frame can be placed in a jig and engraved with the artwork 102. In addition, or in the alternative, the artwork 102 can be added to the artwork frame 100 by some form of embossing. Or, if desired, the artwork 102 can be added to the frame by stamping the frame in a die.

No matter how the artwork 102 is added to the artwork frame 100, the artwork frame 100 can be attached to a mount or rail corresponding in design to the rail (or other mount) selected for the artwork frame 100 as shown at reference 1508. For instance, in scenarios involving Picattiny rails, the rail engagement portion 110 can be aligned with the Picatinny rails of the object on which the artwork 102 will be displayed and slid thereon. Furthermore, the sliding engagement between the rail engagement portion 110 and the rail can continue until the stop 116 reaches a slot in the Picattiny rail. Furthermore, method 1500 can include securing the artwork frame 100 to its mount. More specifically, one or more weapons tool 308 and/or 508 can be slid into the weapons tools apertures 118 so that the weapons tool 308 and/or 508 engages a slot of the mount. Thus, the weapons tool 308 and/or 508 can help hold the artwork frame 100 in a fixed relationship with its mount. See reference 1510.

Of course, some mounts for the artwork frame 100 (such as those on a weapon 200) might expose the artwork frame 100 to shock. For instance, if the artwork frame 100 is mounted to an AR then the repeated firing of the weapon 200 will cause shocks to be transmitted from the barrel of the weapon 200, through the tactical rail 201, and thence to the artwork frame 100 whether reduced in magnitude or not. The hot exhaust gases within the barrel of the weapon 200 might heat the barrel causing the tactical rail to warm too at least to some degree. In turn, that warming can cause the ridges 112 of the rail engagement portion 110 to also heat up. Thus, a portion of the artwork frame 100 can be exposed to such shock and/or temperature excursions. But, again, if it is desired to use the artwork frame 100 in such environments, its materials of construction and/or other aspects of its configuration can be selected so that it is sufficiently rugged to survive therein. See reference 1512.

At some point the user might desire to change the artwork 102 displayed on the mount. For instance, a gun owner might want to display a different piece of artwork 102 at a gun show than they might want to display at a shooting range or out in the field, forest, jungle, etc. Of course, many other scenarios could create a desire to change the artwork 102. Thus, the user can detach or remove the artwork frame 100 from its mount as illustrated by reference 1514. Another artwork frame 100 with differing artwork 102 can be attached to the mount in accordance with the user's desires. See reference 1516.

Furthermore, the artwork frames 100 of embodiments do allow the user to store weapons tools 308 and/or 508 in the tool apertures 118. As a result, it is possible that a user might wish to use one or more of these tools. To do so, the user can select the tool and free it from its tool aperture 118. The user could then use the tool to, for instance, maintain a weapon 200. When the user no longer desires to use the tool, the user can re-insert it into the tool aperture 118 thereby returning it to storage. See reference 1518. Of course, since artwork frames 100 of embodiments provide for storage of the weapons tools 308 and/or 508, the user need not carry these weapons tools 308 and/or 508 separately or even carry a bag or other container for them thereby easing logistical considerations which might need to be accommodated.

Of course, method 1500 can be repeated in whole or in part as indicated at reference 1520. If the user does wish to repeat a portion of method 1500, FIG. 15 indicates that the user can begin method 1500 again (perhaps omitting some portions thereof). Otherwise, FIG. 15 shows that the method 1500 can end.

Figure 16:
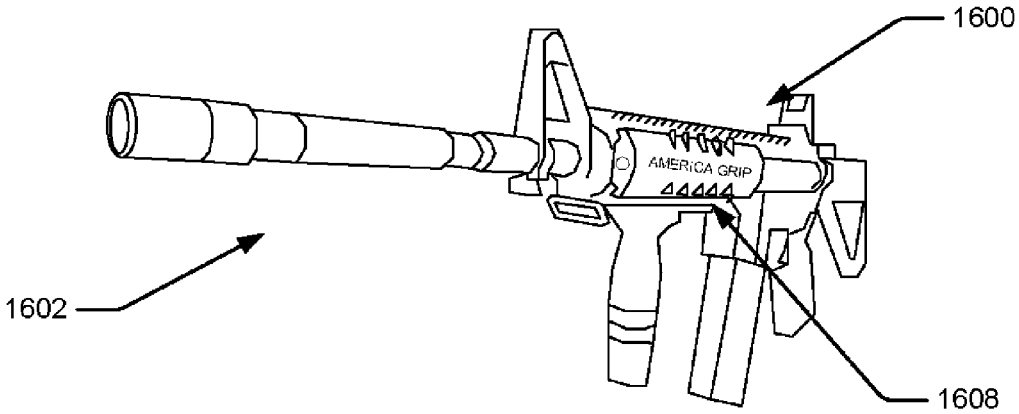
FIG. 16 is a perspective view of an artwork frame mounted on an object.
Figure 17:
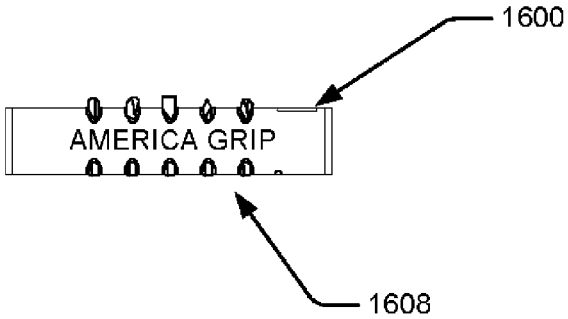
FIG. 17 is a top plan view of an artwork frame.
Figure 18:
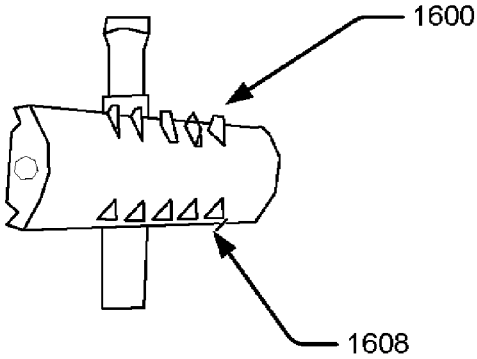
FIG. 18 is a perspective view of an artwork frame.
Figure 19:
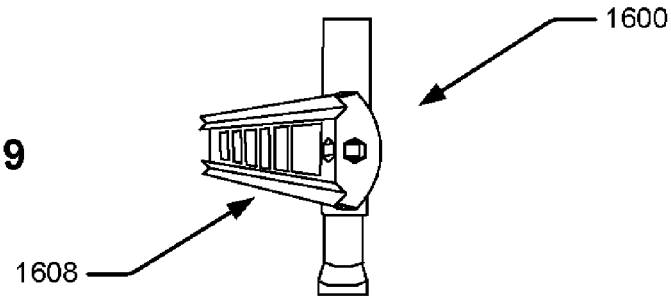
FIG. 19 is yet another perspective view of an artwork frame.

With reference now to FIGS. 16-19, these figures are photographs of an artwork frame 1600. More specifically, the artwork frame 1600 is shown in FIG. 16 being mounted to an object 1602 (here an automatic weapon). It is also shown, holding a set of tools 1608 which individually and/or in combination secure the artwork frame 1600 to the object 1600 (when mounted thereon). FIGS. 16-19 also illustrate the ornamental appearance of the artwork frame 1600 of the current embodiment. Although, the particular artwork displayed thereon (the term "America Grip") does not limit the scope of the current disclosure. For instance, the artwork could be graphical in nature.

As FIGS. 1-19 and the disclosure herein illustrate, embodiments provide ruggedized artwork frames and/or artwork frames which can be mounted on tactical rails and/or other structures. Moreover, the curve-linear display areas of embodiments can cause the artwork displayed therein to assume a more prominent appearance than it would otherwise assume on a flat display area. The three dimensional nature of some artwork can further enhance the visual appearance of that artwork. Additionally, some embodiments provide art-decorated hand guards for weapons of various sorts. Some artwork frames disclosed herein can be removable attached to their mounts and can be secured thereto using weapons tools as lynchpins, cotter pins, etc. to secure the artwork to the structures on which they are mounted. Embodiments also provide methods of manufacturing artwork frames and hand guards and methods for displaying artwork on weapons.

CONCLUSION

Although the subject matter has been disclosed in language specific to structural features and/or methodological acts, it is to be understood that the subject matter defined in the appended claims is not necessarily limited to the specific features or acts disclosed above. Rather, the specific features and acts described herein are disclosed as illustrative implementations of the claims.

The invention claimed is:

1. A ruggedized frame for displaying a three-dimensional and user-selected piece of artwork, the artwork frame comprising:

a frame portion adapted to display the piece of artwork, the artwork frame portion further comprising a frame body defining a generally arc-shaped cross-section as viewed along a longitudinal axis of the frame body and a display area disposed on an exterior surface of the arc-shaped frame body, a rail-engagement portion coupled to the frame portion and further comprising a pair of ridges extending generally inward from an interior surface of the arc-shaped frame body and being adapted to engage a tactical rail, wherein the frame body is substantially spaced apart from the tactical rail when the frame is mounted on the rail, a stop adapted to engage a slot associated with the tactical rail; said rail engagement portion defining a tool aperture adapted to receive a weapons tool wherein, when the ridges are engaged with the tactical rail and the tool aperture has received the weapons tool, the weapons tool engages the slot, and wherein the display area defines the three-dimensional and user-selected piece of artwork therein which further defines a thinned section of the frame body, wherein the frame body and rail engagement portion are adapted to withstand a shock transmitted from the tactical rail of at least 16 foot-pounds and wherein the frame body defines a flat adjacent to one of the ridges and being adapted to increase friction between the artwork frame and the tactical rail.

2. The artwork frame of claim 1 wherein an engraving defines the three-dimensional and user-selected piece of artwork.

3. A frame for displaying a three-dimensional piece of artwork, the artwork frame comprising:

a frame portion adapted to display the piece of artwork, the artwork frame portion further comprising a frame body defining a generally curve-linear cross-section as viewed along a longitudinal axis of the frame body and a display area disposed on an exterior surface of the arc-shaped frame body; and a rail-engagement portion coupled to the frame portion and further comprising a pair of ridges extending generally inwardly from an interior surface of the curve-linear frame body and being adapted to engage a tactical rail wherein the frame body is substantially spaced apart from the tactical rail when the frame is mounted on the rail, said rail engagement portion defining a tool aperture adapted to receive a weapons tool wherein, when the ridges are engaged with the tactical rail and the tool aperture has received the weapons tool, the weapons tool engages a slot associated with the tactical rail;

wherein the display area defines the three-dimensional piece of artwork therein.

4. The artwork frame of claim 3 wherein the frame body and rail engagement portion are adapted to withstand a shock transmitted from the tactical rail of at least 45 foot-pounds.

5. The artwork frame of claim 3 wherein the frame body defines a flat adjacent to one of the ridges configured to increase friction between the artwork frame and the tactical rail.

6. The artwork frame of claim 3 wherein the frame body is adapted to be a hand guard for an automatic weapon.

7. The artwork frame of claim 3 wherein the pair of ridges are further adapted to engage a Picattiny rail.

8. The artwork frame of claim 3 wherein the artwork frame portion further defines a stop adapted to engage a slot associated with the tactical rail.

9. The artwork frame of claim 3 wherein an engraving defines the three-dimensional piece of artwork.

10. The artwork frame of claim 3 wherein the three-dimensional piece of artwork defines a thinned section of the frame body.

11. A hand guard for a weapon including a barrel, the hand guard comprising:

a frame portion adapted to display a piece of artwork, the artwork frame portion further comprising a frame body defining a generally curve-linear cross-section as viewed along a longitudinal axis of the frame body and a display area disposed on an exterior surface of the arc-shaped frame body; and a rail-engagement portion coupled to the frame portion and further comprising a pair of ridges extending generally inwardly from an interior surface of the curve-linear frame body and being adapted to engage a tactical rail wherein the frame body is substantially spaced apart from the tactical rail when the hand guard is mounted on the rail; said rail engagement portion defining a tool aperture adapted to receive a weapons tool wherein, when the ridges are engaged with the pair of rails and the tool aperture has received the weapons tool, the weapons tool engages a slot associated with the tactical rail wherein the display area defines the three-dimensional piece of artwork therein.

12. The hand guard of claim 11 wherein the frame body and rail engagement portion are adapted to withstand a shock transmitted from the tactical rail of at least 45 foot-pounds.

13. The hand guard of claim 11 wherein frame body defines a flat adjacent to one of the ridges and being configured to increase friction between the artwork frame and the tactical rail.

14. The hand guard of claim 11 wherein the frame body defines a second flat adjacent to the other ridge.

15. The hand guard of claim 11 wherein the artwork frame portion further defines a stop adapted to engage a slot associated with the tactical rail.

16. The hand guard of claim 11 wherein an engraving defines the three-dimensional piece of artwork.

17. The hand guard of claim 11 wherein the three-dimensional piece of artwork defines a thinned section of the frame body.

* * * * *